US009114924B2

(12) United States Patent
Titkos

(10) Patent No.: US 9,114,924 B2
(45) Date of Patent: Aug. 25, 2015

(54) PRODUCT PACKAGE WITH CORNER PROTECTORS

(71) Applicant: TARGET BRANDS, INC., Minneapolis, MN (US)

(72) Inventor: Laszlo Titkos, Shoreview, MN (US)

(73) Assignee: Target Brands, Inc., Minneapolis, MN (US)

( * ) Notice: Subject to any disclaimer, the term of this patent is extended or adjusted under 35 U.S.C. 154(b) by 182 days.

(21) Appl. No.: 14/026,176

(22) Filed: Sep. 13, 2013

(65) Prior Publication Data

US 2014/0262924 A1 Sep. 18, 2014

Related U.S. Application Data

(60) Provisional application No. 61/802,268, filed on Mar. 15, 2013.

(51) Int. Cl.

| | |
|---|---|
| ***B65D 81/02*** | (2006.01) |
| ***B65D 85/30*** | (2006.01) |
| ***B65D 81/05*** | (2006.01) |
| ***B65D 5/46*** | (2006.01) |

(52) U.S. Cl.
CPC ..... *B65D 81/057* (2013.01); *B65D 5/4604* (2013.01)

(58) Field of Classification Search
CPC ..... B65D 2581/053; B65D 81/056; B65D 81/054; B65D 5/5033; B65D 2581/055; B65D 2581/058; B65D 81/057
USPC ..... 206/586, 284, 594, 449, 450, 451, 453, 206/454, 455, 521, 591, 592, 736, 45.26, 206/806, 745; 229/103.2, 103.3, 117.24, 229/199, 915, 918, 919; 40/722, 781, 782, 40/786, 788
See application file for complete search history.

(56) References Cited

U.S. PATENT DOCUMENTS 2,226,601 A 12/1940 Euller
3,019,957 A 2/1962 Palmer
(Continued)

FOREIGN PATENT DOCUMENTS

DE 19603708 A1 8/1997

OTHER PUBLICATIONS

Copy of Office Action from Canadian Patent Application No. 2,827,163, mailed Nov. 29, 2013 (2 pages).
(Continued)

*Primary Examiner* — Jacob K Ackun
*Assistant Examiner* — Rafael Ortiz
(74) *Attorney, Agent, or Firm* — Griffiths & Seaton PLLC; JoAnn M. Seaton

(57) ABSTRACT

A product package includes a backer and a corner protector. The backer includes a back panel, a flange, one or more fold lines, and a slot. The one or more fold lines extend along an edge of the back panel, and the slot is positioned near the one or more fold lines. The flange extends from the one or more fold lines and is folded about the one or more fold lines to extend over the back panel. The corner protector includes a front section, a side section, and a rear section. The front section extends substantially parallel to and spaced from the back panel, and the side section extends from the front section toward the backer. The rear section extends from the side section opposite the front section and through the slot of the backer. The rear section is maintained between the back panel and the flange.

21 Claims, 11 Drawing Sheets

(56) References Cited

U.S. PATENT DOCUMENTS

| | | | |
|---|---|---|---|
| 3,349,984 | A | 10/1967 | Halko, Jr. |
| 4,127,192 | A | 11/1978 | Card |
| 4,134,496 | A | 1/1979 | Smith |
| 4,385,698 | A | 5/1983 | Goguen |
| 4,479,318 | A | 10/1984 | Russell |
| 4,598,825 | A | 7/1986 | Wiley et al. |
| 4,951,821 | A | 8/1990 | Kempkes |
| 5,076,432 | A | 12/1991 | Wolf et al. |
| D384,585 | S | 10/1997 | Swarr |
| 5,799,429 | A | 9/1998 | Speshyock |
| 6,163,999 | A | 12/2000 | Taussig |
| 7,350,646 | B2 | 4/2008 | Durrant |
| 8,052,103 | B2 | 11/2011 | Ferraro et al. |
| 2008/0179216 | A1 | 7/2008 | Kari |
| 2009/0178321 | A1 | 7/2009 | Kucharski |

OTHER PUBLICATIONS

"Plastic Protection Corner for Photo Frame", printed from http://annyzhang1.en.made-in-china.com/product/ToUmbhgMaqRD/China-Plastic-Protection-Corner-for-Photo-Frame.html, publicly available at least as early as Feb. 15, 2012 (3 pages).

Photographs of packaging for wall hanging retail items publicly used at Target stores (admitted prior art) (1 page).

PRODUCT PACKAGE WITH CORNER PROTECTORS

CROSS-REFERENCE TO RELATED APPLICATION

This application is a non-provisional application of and claims priority under 35 U.S.C. §119 to U.S. Provisional Patent Application No. 61/802,268, filed Mar. 15, 2013, which is incorporated herein by reference.

BACKGROUND OF THE INVENTION

Retailers are continually evolving product displays in hopes of discovering more effective and visually attractive means for displaying products to potential consumers. The retail display of frames, artwork, other wall hangings, or similar products offered for retail sale presents specific challenges as potential consumers generally want to view and/or tactilely examine edges and corners of the products, but the same areas of the products need to be protected during transport and display. Consequently, new aesthetically pleasing packaging that allows for tactile examination and viewing while still protecting the products from inadvertent damage are desired.

SUMMARY OF THE INVENTION

One aspect of the present invention relates to a product package including a backer and a corner protector. The backer is formed from as a single piece and includes a back panel having an edge, a flange, one or more fold lines, and a slot. The one or more fold lines extend along the edge of the back panel, and the slot is positioned near the one or more fold lines. The flange extends from the one or more fold lines away from the back panel and is folded about the one or more fold lines to extend over the back panel. The corner protector is formed as a single piece separate from the backer and includes a front section, a side section, and a rear section. The front section extends substantially parallel to and spaced from the back panel of the backer, and the side section extends from the front section toward the backer. The rear section extends from the side section opposite the front section and through the slot of the backer. The rear section is maintained between the back panel and the flange. Other related products, assemblies and methods are also disclosed and provide additional advantages.

BRIEF DESCRIPTION OF THE DRAWINGS

Embodiments of the invention will be described with respect to the figures, in which like reference numerals denote like elements, and in which.

DETAILED DESCRIPTION

Figure 1:
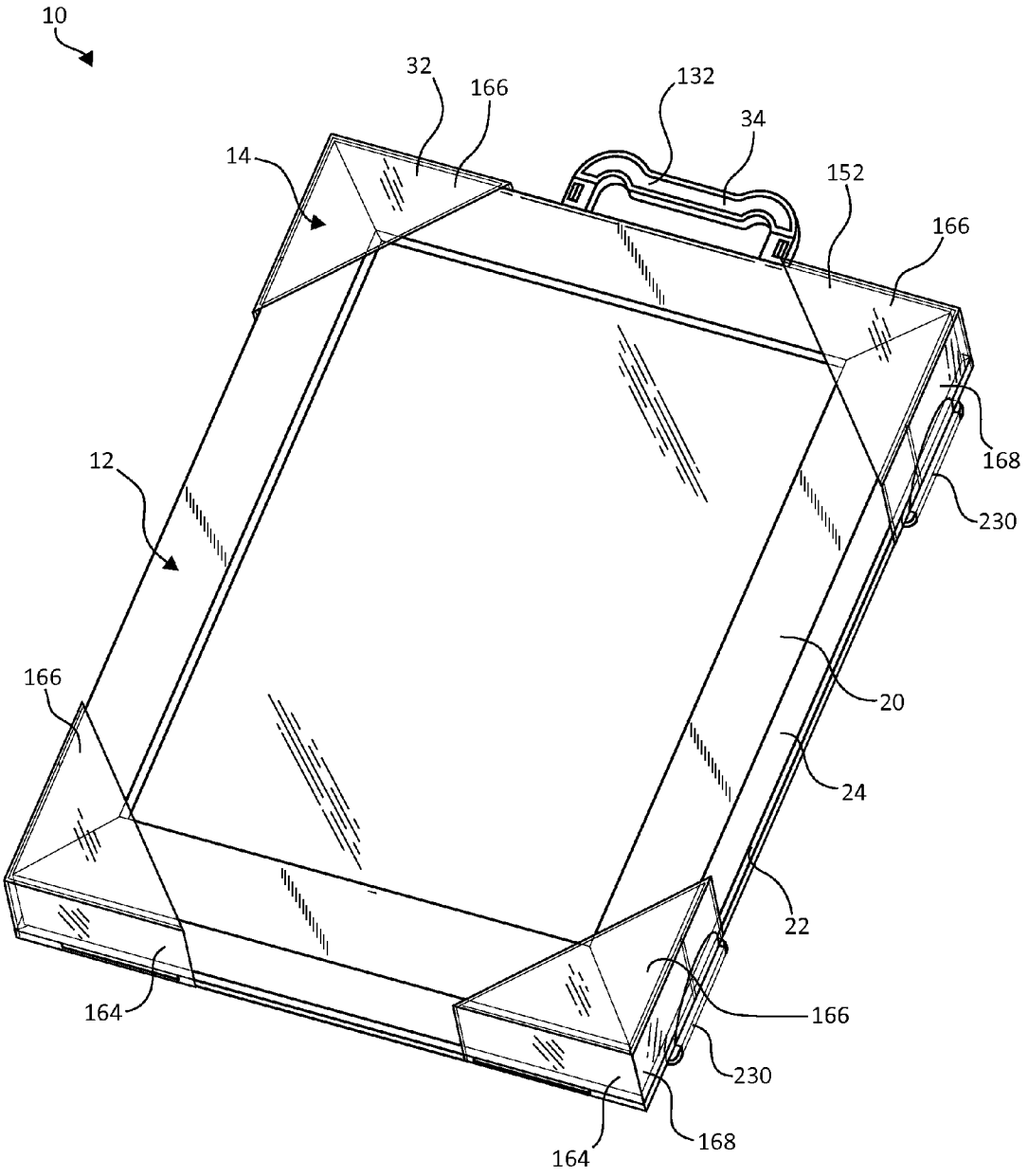
FIG. 1 is a front, perspective view illustrating a retail product assembly, according to one embodiment of the present invention.
Figure 2:
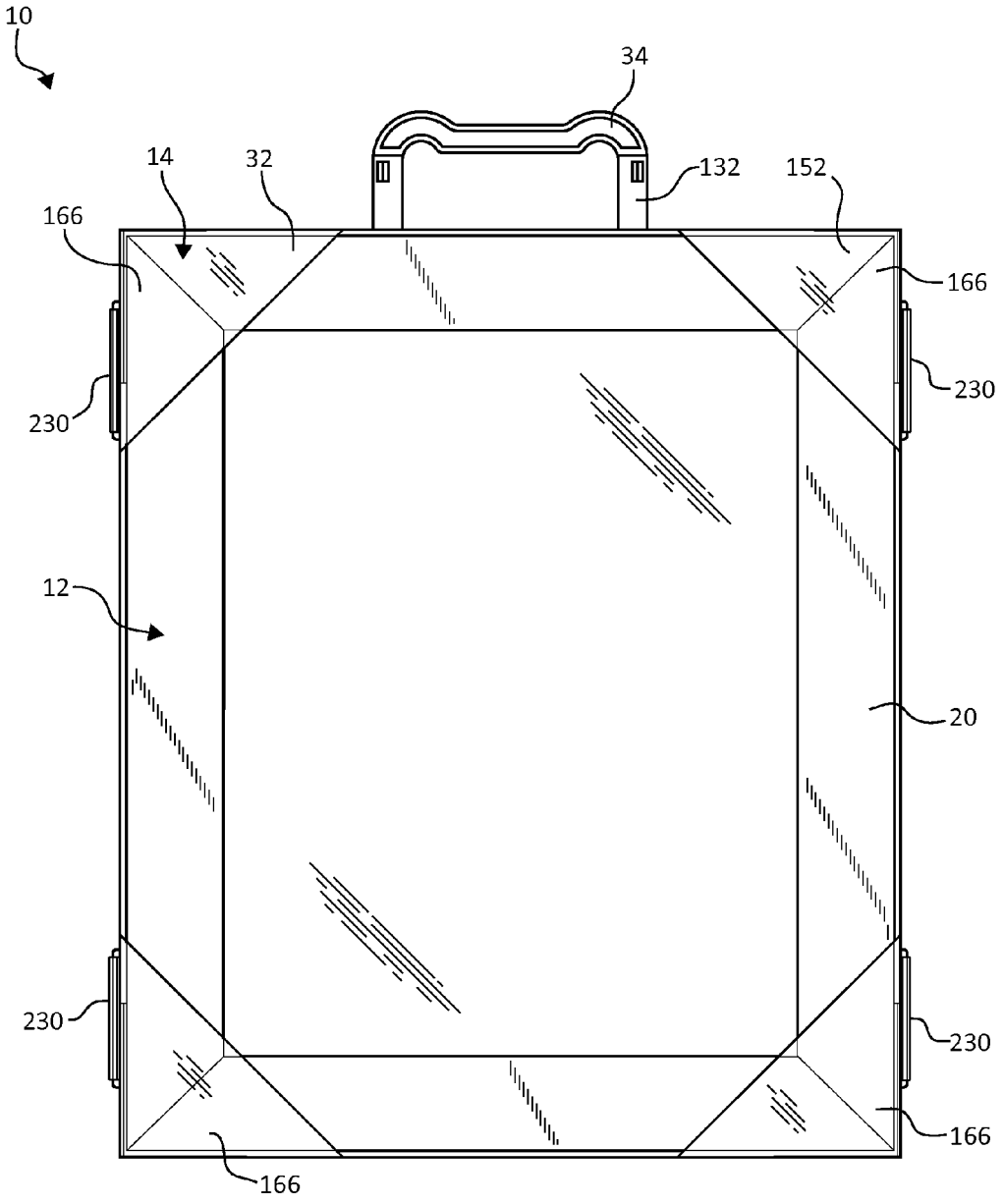
FIG. 2 is a front view illustrating the retail product assembly of FIG. 1, according to one embodiment of the present invention.
Figure 3:
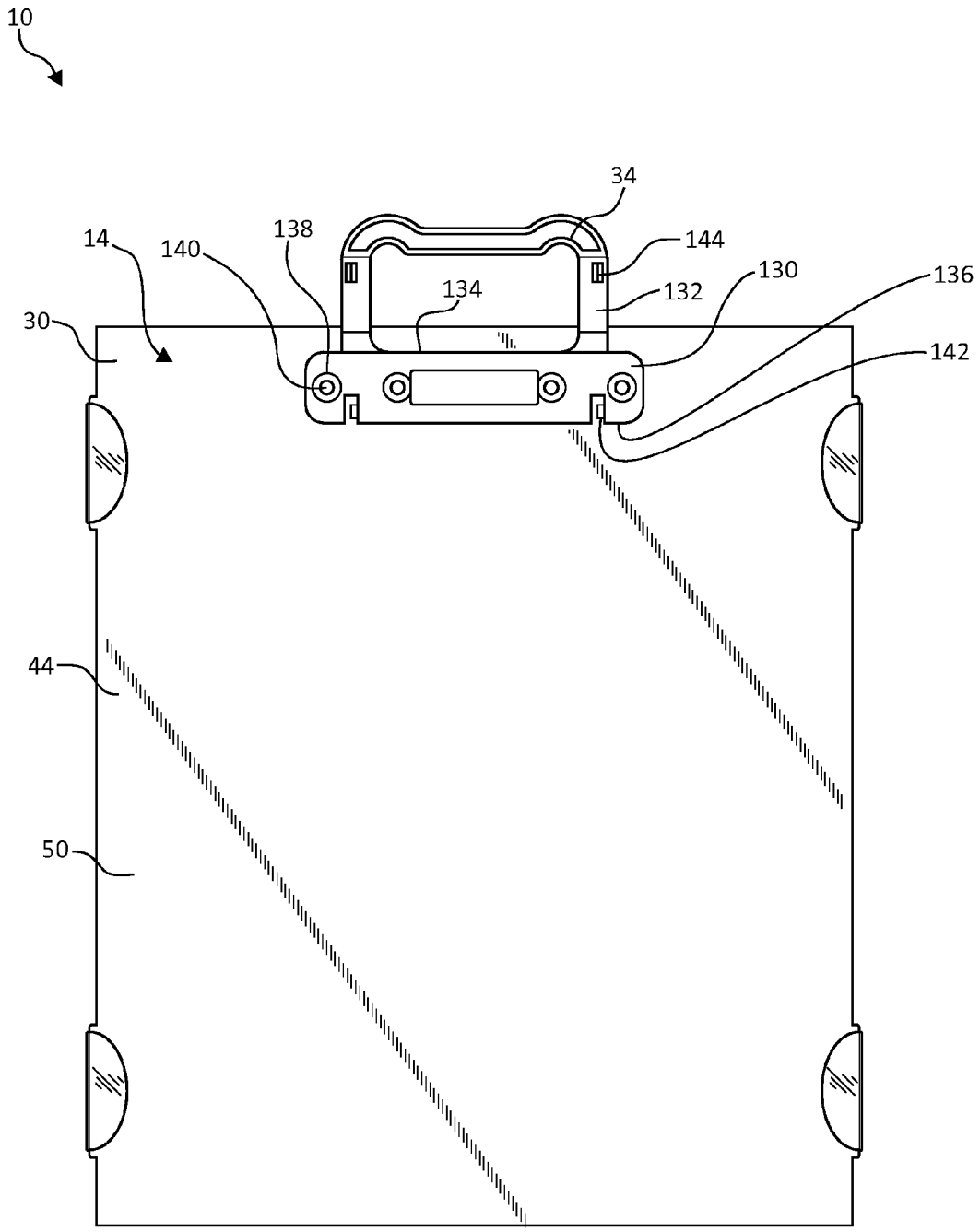
FIG. 3 is a rear view illustrating the retail product assembly of FIG. 1, according to one embodiment of the present invention.
Figure 4:
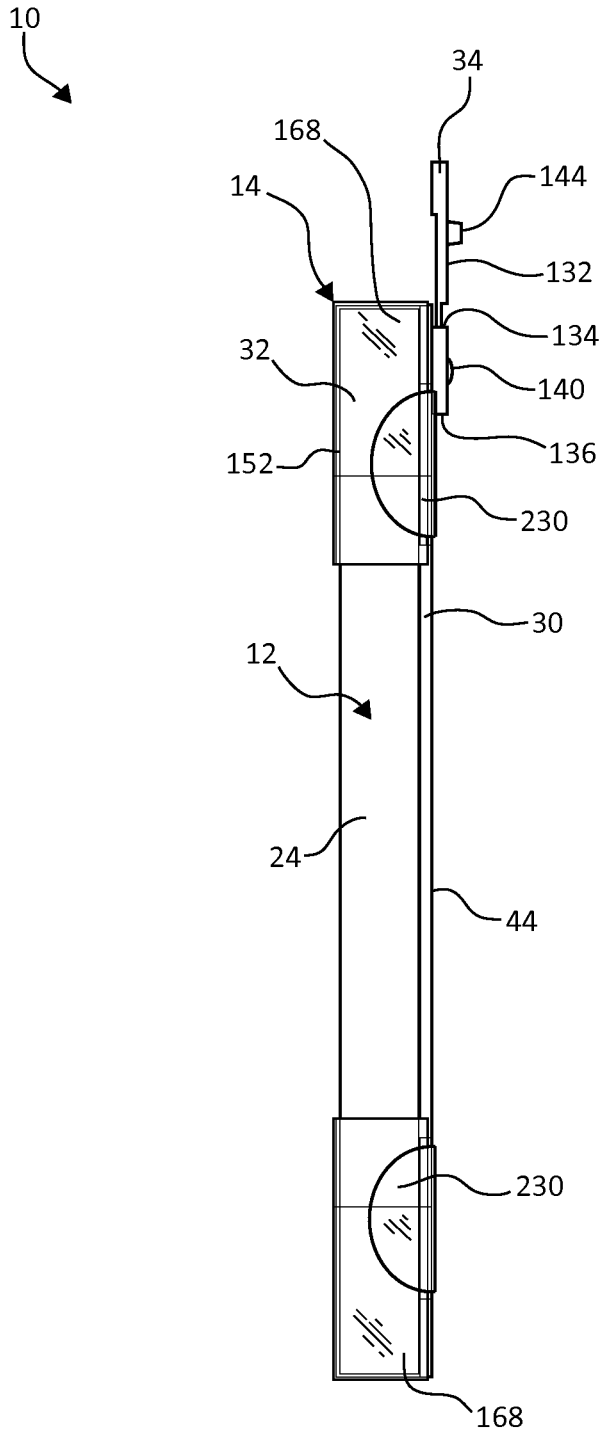
FIG. 4 is a right side view illustrating the retail product assembly of FIG. 1, according to one embodiment of the present invention; the left side view is a mirror image of the right side view.
Figure 5:
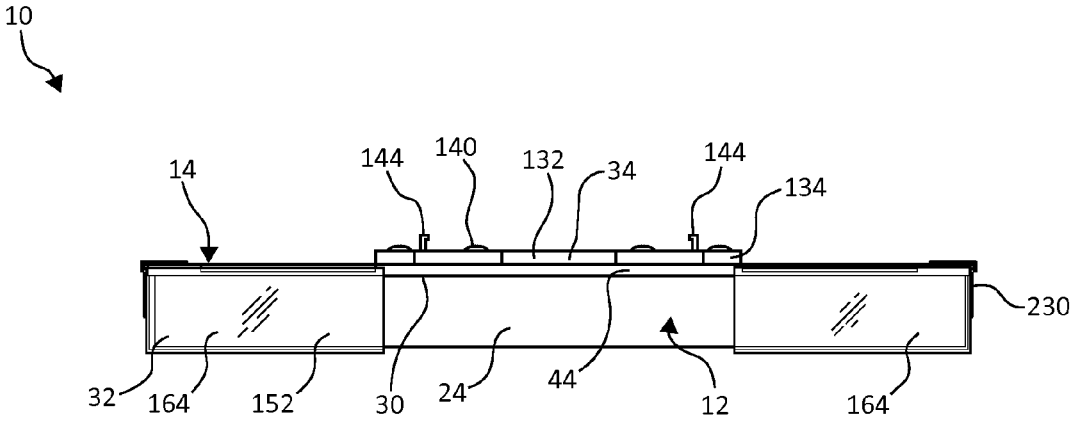
FIG. 5 is a top view illustration of the retail product assembly of FIG. 1, according to one embodiment of the present invention.
Figure 6:
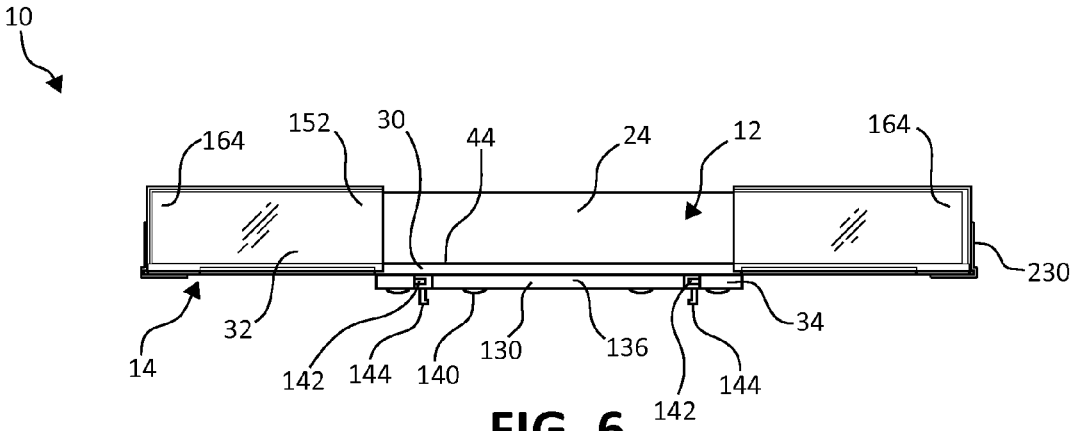
FIG. 6 is a bottom view illustration of the retail product assembly of FIG. 1, according to one embodiment of the present invention.

Embodiments of a product package of the present invention are configured to display a product in a retail display, for example, on a shelf or hung from a retail support rod. More specifically, a package includes a backer sized and shaped to substantially cover a rear surface of the product and corner protectors coupled to the backer to both secure the product to the backer and protect the product from incidental damages. In one example, the corner protectors are substantially transparent allowing a potential consumer to fully view the front and sides of the product without removing the product from the package. In one example, a substantial entirety of the front and side surfaces of the product are exposed even while the product is in the package thereby allowing the potential consumer to interact with and tactilely examine the product without removing it from the package. In one example, the package is assembled without the use of tools.

Turning to the embodiment illustrated in FIGS. 1-6, a retail product assembly 10 includes a product 12 and a package 14, for example, for transport and retail display and sale of product 12. Product 12 is any retail item being offered for sale with suitable overall dimensions, e.g., a largely two-dimensional product with a substantially smaller third dimensional size. Example products 12 include a frame, artwork, other wall hanging, container, or other suitable product. In the illustrated embodiment, product 12 includes a front surface 20, a rear surface 22 (generally indicated in FIG. 1) substantially opposite front surface 20, and sidewalls 24 extending from a perimeter of front surface 20 to a perimeter of rear surface 22. Front surface 20 and rear surface 22 define a length and a width of product 12, and the length and the width are each substantially greater than a depth of product 12 defined by sidewalls 24, in one embodiment. One or more of front surface 20 and rear surface 22 are substantially planar, in one example. In other examples, one or more of front surface 20 and rear surface 22 is substantially non-planar.

In one example, package 14 includes a backer 30 and corner protectors 32. Each of backer 30 and corner protectors 32 is assembled with one another substantially without the use of tools. In one example, backer 30 is formed of cardboard, paperboard, or other suitably rigid yet readily disposable material, and each corner protector 32 is formed from a piece of a substantially transparent sheet. Backer 30 and corner protectors 32 interact with each other via fold lines, slots, and tabs substantially or entirely without the use of tools as illustrated in the figures. In one example, package 14 additionally includes a hanger 34 to facilitate hanging package 14 from a retail support in a retail display (not shown).

Figure 7:
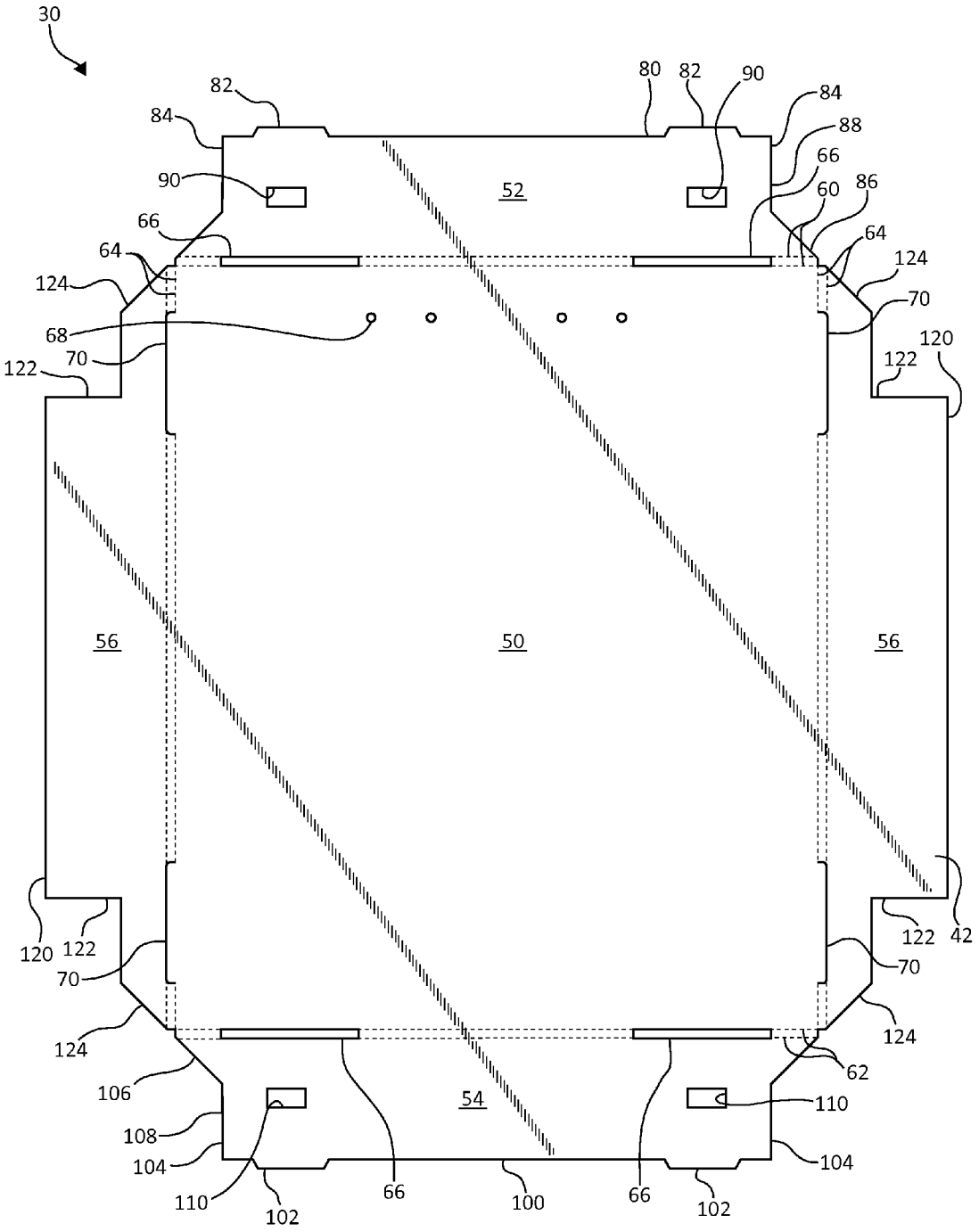
FIG. 7 is a front view illustration of an unfolded backer of the retail product assembly of FIG. 1, according to one embodiment of the present invention.
Figure 8:
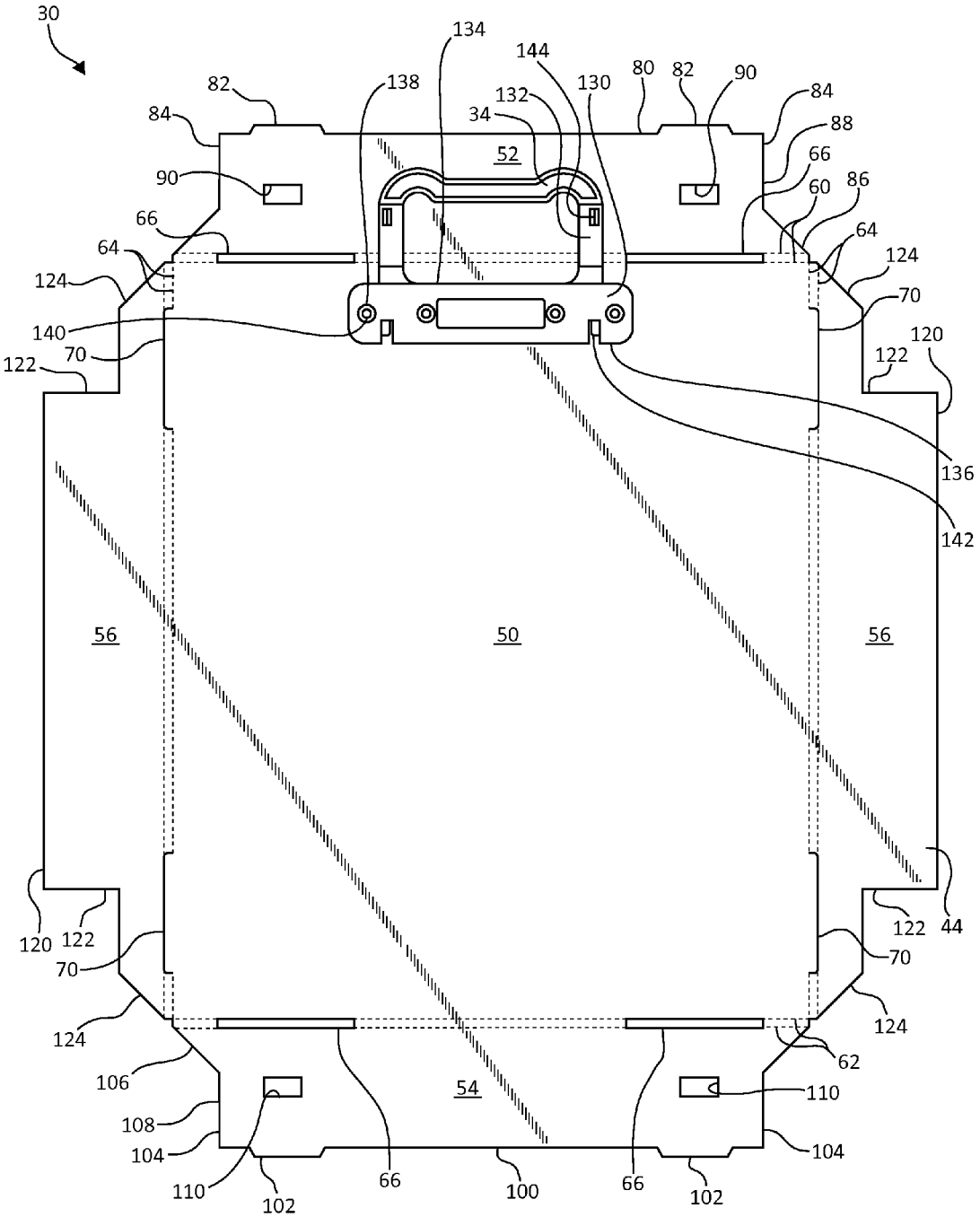
FIG. 8 is a rear view illustration of the unfolded backer of FIG. 7, according to one embodiment of the present invention.

Backer 30 is formed, more particularly, from a folded cardboard or similarly formed flat blank as illustrated in FIGS. 7 and 8. Backer 30 is substantially planar and defines an interior surface 42 and an opposite exterior surface 43. In one embodiment, backer 30 includes a back panel 50, a top flange 52, a bottom flange 54, and opposing side flanges 56. Each of top flange 52, bottom flange 54, and opposing side flanges 56 extend from a different fold line along an outer perimeter edge of back panel 50 and are adapted to be folded inwardly over the corresponding fold lines back onto interior surface 43 of back panel 50. It should be understood that directional terminology used throughout this application is provided for clarity with respect to the orientation of the drawings rather than referring to "a first side," "a second side," "a third side," etc. Terminology such as "top," "bottom," "left," "right," "side," "upward," "downward," etc. should be understood to be relative to an illustrated orientation and are not intended to limit use of the retail product assembly in which the entire assembly is rotated, e.g., rotated 90 degrees or 180 degrees in either direction.

More specifically, back panel 50 is formed with overall dimensions and shape substantially identical to, but slightly larger than the overall dimensions and shape of product 12. In the illustrated embodiment, product 12 and back panel 50 are both substantially identically formed as rectangles. Backer 30 defines a different fold line along each linear boundary edge of back panel 50. In particular, backer 30 defines a top fold line pair 60 extending along a top perimeter portion of back panel 50, a bottom fold line pair 62 extends along a bottom perimeter portion of back panel 50, and opposing side fold line pairs 64 extend along opposing side perimeter portions of back panel 50. Each fold line pair 60, 62, and 64 is formed by two substantially parallel fold lines positioned apart a distance substantially equal to or greater than twice a thickness of backer 30, in one embodiment. In one example, a single fold line is used as an alternative to one or more of fold line pairs 60, 62, and 64.

Top flange 52 extends outwardly away from top fold line pair 60 to top free edge 80, for example, a topmost free edge that extends substantially in parallel with top fold line pair 60. One or more tabs 82, for example, two tabs 82 are defined to extend slightly upwardly from a remainder of top free edge 80. Each tab 82 is spaced from but positioned near to side edges 84 of top flange 52. Side edges 84 extend from top free edge 80 toward top fold line pair 60. In one example, side edges 84 extend from top free edge 80 with an initially linear and substantially perpendicular orientation relative to each of top fold line pair 60 and top free edge 80. A second portion 86 of side edge 84 angles from a first portion 88 of the respective side edge 84 outwardly and downwardly, tapering toward a respective end of top fold line pair 60. In one example, elongated slots 66 are defined at two locations along top fold line pair 60 and each extends between the two fold lines comprising top fold line pair 60. Each slot 66 is, in one example, centered laterally (e.g., left and right in FIGS. 7 and 8) relative to one of tabs 82, and has a longer lateral dimension than the one of tabs 82. Two internal, coupling apertures 90, for example, rectangular coupling apertures, are defined between top fold line pair 60 and top free edge 80. Each coupling aperture 90 has a lateral position centered with respect to different corresponding ones of tabs 82 and slots 66.

Bottom flange 54 extends outwardly away from bottom fold line pair 62 to bottom free edge 100, for example, a topmost free edge that extends substantially in parallel with bottom fold line pair 62. One or more tabs 102, for example, two tabs 102, are defined to extend slightly upwardly from a remainder of bottom free edge 100. Each tab 102 is spaced from, but positioned near to, side edges 104 of bottom flange 54. Side edges 104 extend from bottom free edge 100 back toward bottom fold line pair 62. In one example, a first portion 108 of each side edge 104 extends from bottom free edge 100 with an initially linear orientation substantially perpendicular to each of bottom fold line pair 62 and bottom free edge 100. A second portion 106 of each side edge 104 angles from an outside end of first portion 108 of the respective side edge 104 outwardly and upwardly, tapering toward a respective end of bottom fold line pair 62. In one example, elongated slots 66 are defined at two locations along bottom fold line pair 62 and each extends between the two fold lines comprising bottom fold line pair 62. Each slot 66 is, in one example, centered laterally (e.g., left and right in FIGS. 7 and 8) relative to one of tabs 102, and with a longer lateral dimension than the one of tabs 102. Two internal, coupling apertures 110, for example, rectangular coupling apertures, are defined between bottom fold line pair 62 and bottom free edge 100. Each coupling aperture 110 has a lateral position centered with respect to different corresponding ones of tabs 82 and slots 66.

In one embodiment, side flanges 56 are formed as substantially mirror images of one another on opposing sides of back panel 50. Each of side flanges 56 extends outwardly away from a different one of side fold line pairs 64 to a side free edge 120, for example, an outermost free edge that extends substantially in parallel with side fold line pair 64. A different cutout 122 is formed at each end of side free edge 120 with a substantially L-shape. Side edges 124 extend from outermost edges of cutouts 122 inwardly and longitudinally outwardly to a corresponding side fold line pair 64. In one example, C-shaped or U-shaped cut lines or slits 70 are defined at two spots along side fold line pair 64 between the two fold lines comprising side fold line pair 64. Each slit 70 is, in one example, elongated and defined near a different end of each side fold line pair 64. Each slit 70 extends between the two corresponding fold lines of a side fold line pair 64 and longitudinally along the outermost fold line of the corresponding side fold line pair 64.

Hanger 34 is any suitable hanger, member, or other device to facilitate placement of retail product assembly 10 in a retail setting. In one example, hanger 34 is similar to the hangers described in U.S. Pat. No. 8,418,858, issued on Apr. 16, 2013, which is hereby incorporated by reference in its entirety. Hanger 34, as shown in the illustrated embodiment of FIGS. 1-6 and 8, for example, includes a primary panel 130 and a U-shaped hooked section 132 extending away from and hingedly coupled with primary panel 130. More specifically, primary panel 130 is substantially rectangular and defines a top edge 134 and a bottom edge 136 opposite top edge 134. Apertures 138 extend through an interior portion of primary panel 130 located between top edge 134 and bottom edge 136.

During use, hanger 34 is coupled to a portion of exterior surface 44 defined by back panel 50 of backer 30 according to the illustrated embodiment. More specifically, primary panel 130 is coupled with back panel 50, for example, via suitable fasteners 140 extending through apertures 138 of hanger 34 and coupling apertures 68 of back panel 50. Hooked section 132 extends from top edge 134 of primary panel 130 and is configured to fold and unfolded about its hinged coupling with primary panel 130 to move between a position extending above a remainder of retail product assembly 10 during use and a position within the overall footprint of retail product assembly 10 during transport. When in a use position, hooked section 132 is placed over supporting rods or other suitable structure in a retail display (not shown) to hang retail product assembly 10 therefrom. In one example, hanger 34 is eliminated from retail product assembly 10.

Figure 9:
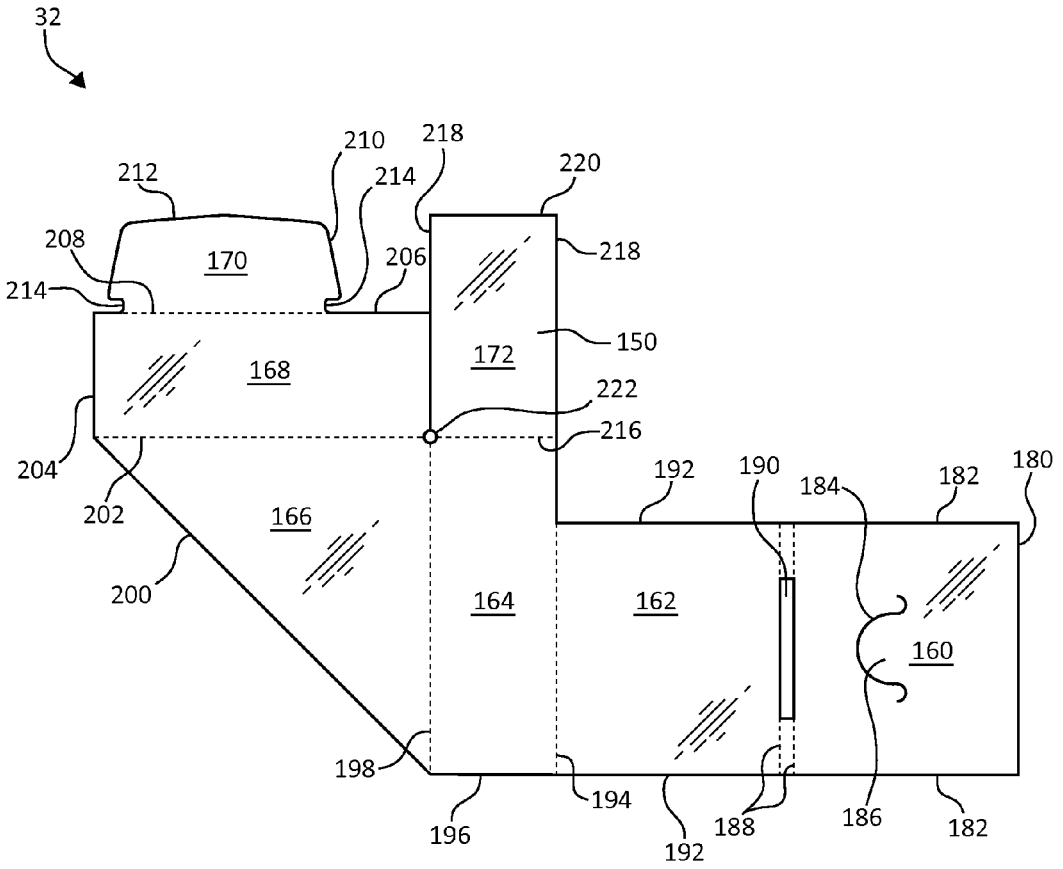
FIG. 9 is a front view illustration of an unfolded corner protector of the retail product assembly of FIG. 1, according to one embodiment of the present invention.

Package 14 includes two or more corner protectors 32, for example, four corner protectors 32. Corner protectors 32 are each configured to be placed around at least two opposing corners of product 12 to securely maintain product 12 in package 14. In one embodiment, each corner protector 32 is substantially identical and interacts with backer 30 in a substantially identical fashion, but in a different corner of backer 30 with a corresponding different orientation. In one example, each corner protector 32 is formed of a flat blank of a sheet material that may have thermoformed pre-folded or other wise defined fold lines. In one example, the sheet material is transparent, translucent, or opaque. Each corner protector 32 defines an interior surface 150 (FIG. 9), which generally faces toward product 12 upon assembly of retail product assembly 10, and an exterior surface 152), which generally faces away from product 12 upon assembly of retail product assembly 10.

In one example, as illustrated in at least FIGS. 1-6 and 9, corner protector 32 includes a first rear section 160, a second rear section 162, a first side section 164, a front section 166, a second side section 168, a tab 170, and flap 172. First rear section 160 is substantially rectangular and defines and extends between a free end edge 180 and a fold line pair 188. In one embodiment, each fold line in fold line pair 188 and free end edge 180 is substantially linear and extends substantially parallel to one another. First rear section 160 further defines two opposing free side edges 182 extending from and, in one example, substantially perpendicularly to, free end edge 180 to fold line pair 188. First rear section 160 defines a slit 184 in an internal portion thereof, that is, spaced from each of free end edge 180, fold line pair 188 and opposing free side edges 182. In one example, slit 184 is at least partially semi-circular or otherwise suitably shaped to define an internal tab 186 therein. Tab 186 selectively bends slightly rearwardly and away from a remainder of first rear section 160 to interface with backer 30 as will be further described below. In one example, corner protector 32 defines a slit or elongated slot 190 between fold line pair 188.

Second rear section 162 extends from fold line pair 188 away from free end edge 180 to a fold line 194, which extends substantially parallel to each fold line in fold line pair 188. Second rear section 162 is substantially rectangular, in one embodiment, and defines free sides edges 192 extending from and collinearly with free side edges 182 of first rear section 160. First side section 164 extends from fold line 194 away from second rear section 162 to a fold line 198, which extends substantially parallel to fold line 194. In one embodiment, first side section 164 has a height that is greater than a height of each of first rear section 160 and second rear section 162 such that a free edge 196 of first side section 164 extends from and collinearly with one of free side edges 192, and first side section 164 extends away from free edge 196 past the other free side edge 192 to a fold line 216. Fold line 216 extends substantially parallel to free side edges 182 and 192, and free edge 196 and is positioned a further distance away from free side edges 182 and 192 and free edge 196 than free side edges 182 and 192.

Front section 166 extends from fold line 198 to define a front free edge 200, which extends from an end of free edge 196 opposite free side edge 192 and defines an angle of about 45 degrees, with other angles between about 20 degrees and 60 degrees also being contemplated, between front free edge 200 and fold line 198. Front section 166 is triangular, more specifically, in one example, an isosceles triangle, bound by fold line 198, front free edge 200, and a fold line 202. Fold line 202 extends substantially perpendicularly to fold line 198, for example, substantially parallel to free edge 196 and free side edges 192 and 182. Second side section 168 extends away from fold line 202 to a free edge 206 opposite and, in one embodiment, substantially perpendicular to fold line 202. Second side section 168 includes a free edge 204 extending from an end of front free edge 200 opposite free edge 196, for example, in a direction substantially parallel fold line 198.

Tab 170 extends away from free edge 206 along a fold line 208 positioned collinearly with free edge 206. Tab 170 defines free edge 212 opposite fold line 208 and opposing side edges 210 generally extending from fold line 208 to free edge 212. Notches or indentations 214 are formed on opposing side edges 210 substantially immediately adjacent fold line 208 and free edge 206. In one example, tab 170 has a smaller width between indentations 214 than between opposite side edges 210 adjacent indentations 214.

Flap 172 extends from fold line 216 away from first side section 164 to a flap free edge 220. In one embodiment, free edge 220 extends substantially parallel to fold line 216 and is positioned on an opposite side of fold line 216 as compared to free edge 196 of first side section 164. Flap 172 includes cut side edges 218 along opposing sides thereof extending between and, in one example, substantially perpendicular to fold line 216 and flap free edge 220. One of cut side edges 218 extends between and immediately adjacent flap 172 and second side section 168 and terminates in a small circle 222 to decrease the likelihood of tearing corner protector 32 where the corresponding cut side edge 218 terminates at an internal portion of corner protector 32.

Package 14 is assembled at least partially around product 12. If hanger 34 is used, in one example, hanger 34 is coupled to, for instance through, back panel 50, before corner protectors 32 are coupled with backer 30, for example, as illustrated in FIG. 8. In other embodiments, hanger 34 is coupled to package 14 after package 14 is partially or fully assembled and/or coupled with product 12.

Figure 10:
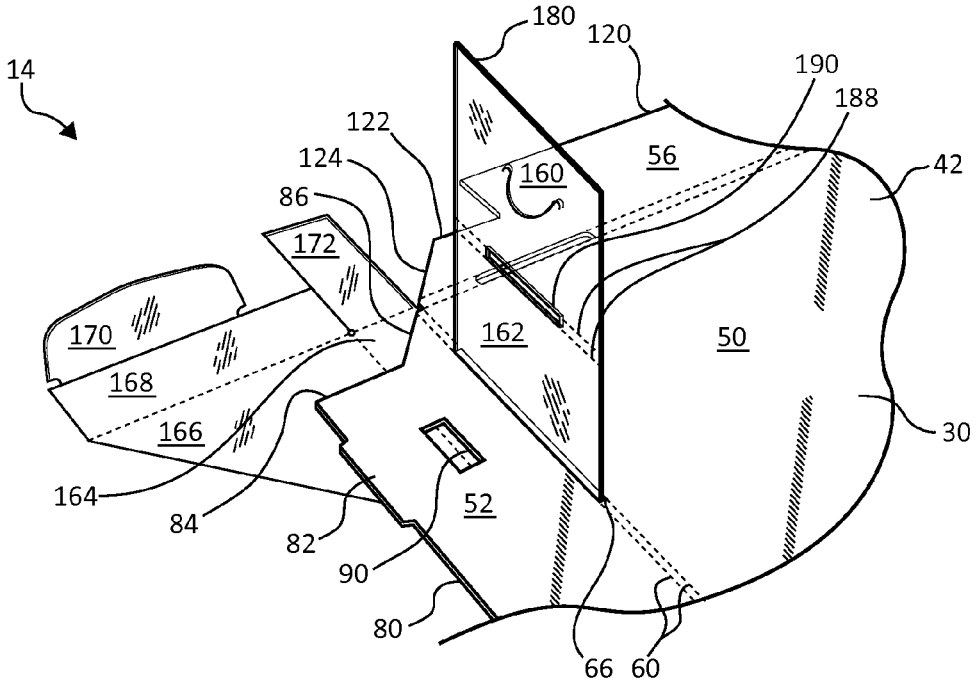
FIGS. 10-14 are partial perspective view illustrations of a package in a sequence of assembly steps during construction of the retail product assembly of FIG. 1, according to one embodiment of the present invention.
Figure 11:
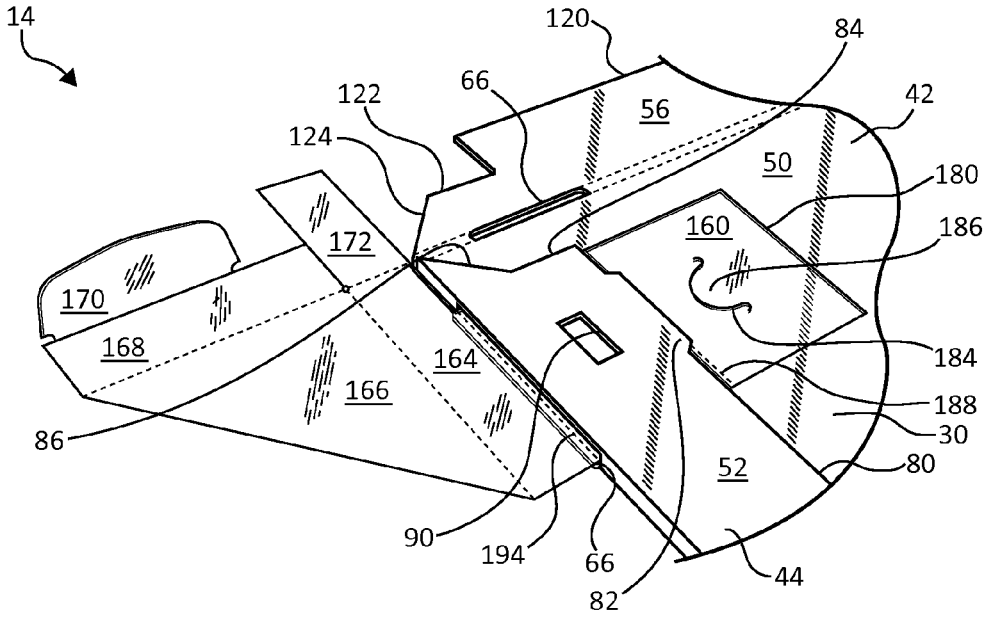
Figure 12:
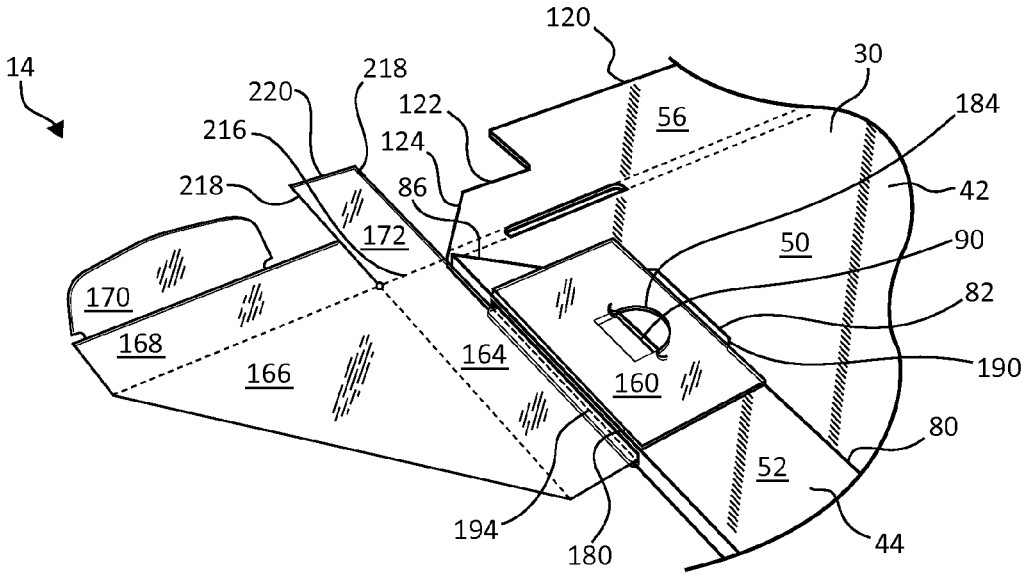

In one embodiment, a first corner protector 32 is coupled to backer 30 as illustrated in FIGS. 10-14, which successively show steps in one example of coupling a top, right one of corner protectors 28 to backer 30. Referring to FIG. 10, in one embodiment, first and second rear sections 160 and 162 of corner protector 32 are slid from an exterior side of backer 30 through one of slots 66 to interior side of backer 30 such that a remainder of corner protector 32 is positioned immediately adjacent and substantially parallel to exterior surface 44 of backer 30. Top flange 52 is folded about fold line pair 60 over back panel 50 such that the portion of exterior surface 44 defined by top flange 52 faces away from back panel 50. Accordingly, top flange 52 is one example of means for partially covering interior surface 42 of back panel 50 along an outer edge of back panel 50. Folding top flange 52 pushes first and second rear sections 160 and 162 down to fit adjacent and extend substantially parallel to portions of interior surface 42 defined by back panel 50 and top flange 52. Referring to FIG. 12, first rear portion 160 is subsequently folded about fold line pairs 188 of corner protector 32 such that slot 190 receives a corresponding tab 82 of backer 30 and a portion of interior surface 150 of corner protector 32 defined by first rear portion 160 is placed immediately adjacent the portion of exterior surface 44 defined by top flange 52. Tab 186 is pressed rearwardly down through a corresponding coupling aperture 90 to further secure first rear section 160 to top flange 52.

Subsequently, as illustrated with reference to FIG. 13, right side flange 56 is folded forwardly over back panel 50 about fold line pair 64 such that a portion of exterior surface 44 formed by side flange 56. In one example, folding right side flange 56 over back panel 50 creates a side slot due to U-shaped slit 70 as the portion of backer 30 inside U-shaped slit 70 does not fold forwardly, but instead remains substantially coplanar with back panel 50 (see also FIGS. 1-3). In one embodiment, folding side flange 56 over back panel 50 forms an aesthetically pleasing mitered corner between top flange 52 and side flange 56 where angled, second portion 86 of side edge 84 of top flange 52 is positioned immediately adjacent angled side edges 124 of side flange 56. Cutout 122 of side flange 56 further accommodates a corner of top flange 52 such that side flange 56 and top flange 52 do not overlap one another such that portions of exterior surface 44 of backer 30 collectively defined by top flange 52, bottom flange 54, and side flange 56 provide an even and substantially planar front surface or base for receiving rear surface 22 of product 12.

After side flange 56 is folded over back panel 50, all of corner protector 32 other than first and second rear sections 160 and 162 is folded about fold line 194 relative to second rear section 162 to extend forwardly from backer 30. When so folded, first side section 164 extends substantially perpendicularly relative to back panel 50, and fold line 194 is positioned in slot 66 of backer 30. Next, flap 172 folds about fold line 216 to extend perpendicular to first side section 164 and just forward from an edge of backer 30 defined by corresponding side fold line pair 64 as is illustrated in FIG. 13.

Figure 13:
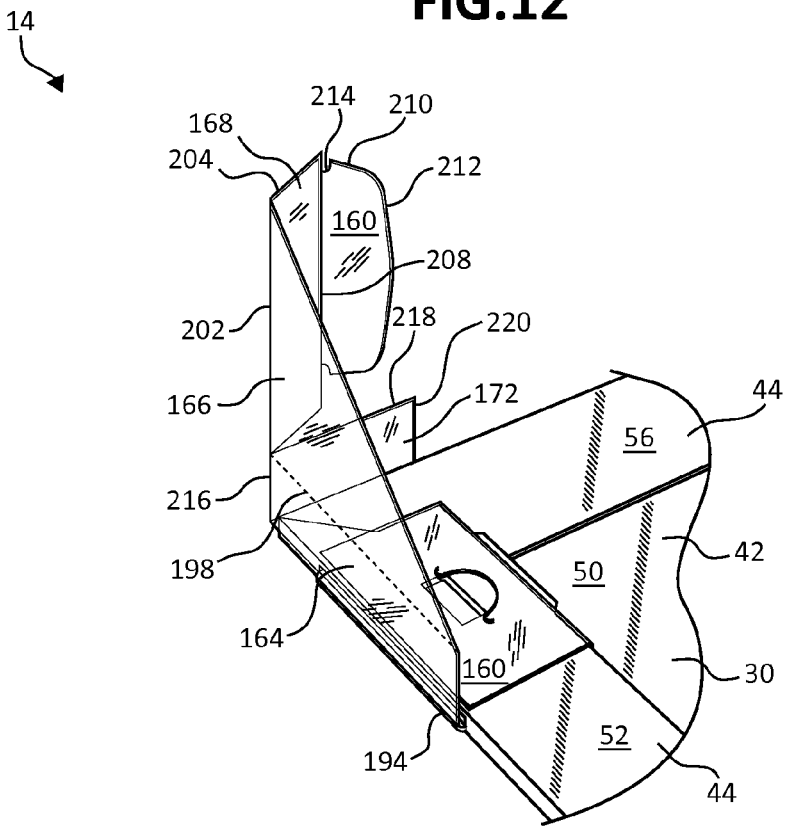
Figure 14:
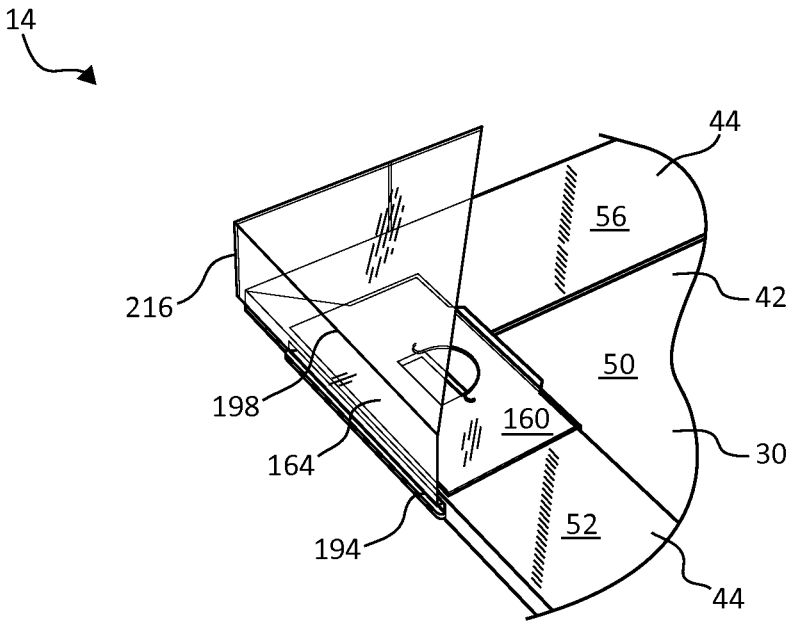
Figure 15:
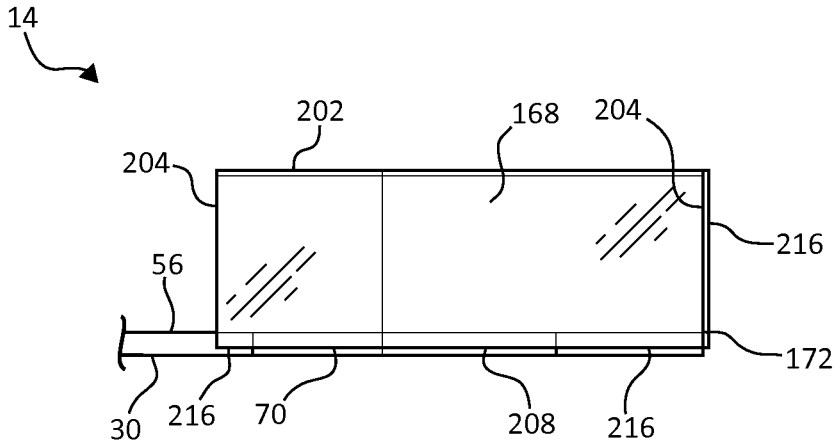
FIG. 15 is a detailed right side view illustration of a top portion of the package of FIG. 14, according to one embodiment of the present invention.

Referring to FIG. 13 in view of FIG. 14 and the corresponding right side view of corner protector 32 of FIG. 15, front section 166 with second side section 168 and tab 170 are folded rearwardly about fold line 198 until front section 166 extends substantially perpendicular to first side section 164 (i.e., substantially parallel to back panel 50). When so positioned, a portion of front section 166 adjacent second side section 168 is placed immediately adjacent a frontmost one of cut edges 218 of flap 172. Subsequently, second side section 168 is folded about fold line 202 and tab 170 is folded about fold line 208, and tab 170 is slid into backer 30 through a slot formed by U-shaped slit 70 when side flange 56 is folded over back panel 50 to lock corner protector in place by receiving a portion of backer 30 adjacent side slots in indentations 214 (FIG. 9) defined by tab 170. In this manner, corner protector 32 forms a substantially triangular chamber adjacent backer 30 at a corner of backer 30. Accordingly, corner protector 32 is one example of means for defining a chamber partially over top flange 52, over side flange 54, and/or over back panel 50 of backer 30.

As will be apparent to those of skill in the art, while the coupling of one corner protector 32 to backer 30 is specifically described and illustrated, in one example, the two top corner protectors 32 are at least partially coupled to backer simultaneously such that both corner protectors 32 are inserted into their respective slot 66 before top flange 52 is folded over backer panel 50. The two bottom ones of corner protectors 32 are coupled to backer 30 partially around bottom flange 54 in a similar manner as the top corner protectors 32 are described above as being coupled with backer 30 partially around top flange 52. No matter the sequence of assembly, corner protectors 32 are nearly entirely positioned within the overall footprint of backer 30, which, when folded for use, has two dimensions just slightly larger than product 12.

Next, the two bottom corner protectors 32 are partially assembled to backer 30 to a point that first rear section 160 is secured to bottom flange 54 and both bottom flange and side flanges 56 are folded over back panel 50. At this point, the two top corners of product 12, defined at an intersection between two sidewalls 24 thereof, are each placed in a different one of the two top corner protectors 32, which also places the two bottom corners of product 12 to align with bottom corners of backer 30. In one example, as illustrated with reference to FIG. 3, when product 12 is positioned relative to backer 30, back panel 50 substantially entirely covers a rear surface 22 of product 12. Accordingly, back panel 50 is one example of means for substantially entirely covering rear surface 12 of product 12.

After product 12 is properly positioned relative to backer 30, the bottom corner protectors 32 are folded over and secured to sides of backer 30 around the bottom corners of product 12 to securely couple product 12 to backer 30. In one example, adhesive members or stickers 230 are subsequently secured to a portion of exterior surface 152 of corner protector 32 defined by second side section 168 and an adjacent portion of exterior surface 44 of backer 30 defined by back panel 50 to further secure corner proctors to backer 30, and therefore, product 12 to package 14. While described as assembling top corner protectors 32 followed by bottom corner protectors 32, the opposite assembly is also contemplated and would produce substantially identical results. No matter the sequence of assembly, corner protectors 32 are nearly entirely positioned within the overall footprint of backer 30, which, when folded for use, has two dimensions just slightly larger than product 12. Also, as described above, the orientation of package 14 can be rotated 90 degrees and still achieve substantially the same results. Other variations in the sequence of assembly will also be apparent to those of skill in the art upon reading this application.

In view of the above, package 14 securely holds product 12 substantially within the overall footprint of product 12 such that right to left and up and down shifting or product 12 is substantially eliminated due to interaction of product 12 with opposing corner protectors. In addition, a height that corner protectors 32 extend from backer 30 is just greater than a thickness of product 12 such that forward and rearward shifting of product 12 in package 14 is decreased and/or substantially eliminated via interaction of product 12 with flanges 52, 54, and 56 of backer 30 and front sections 166 of corner protectors 32. In this manner, package 14 holds product 12 in a secure manner while providing protection to corners of product 12, which are typically the most prone to damage during shipping and/or other handing.

In addition, the sides of product 12 extending between corner protectors 32 remain exposed allowing a consumer to touch, feel, and/or otherwise fully examine the profile, finish, texture, thickness, etc. of product 12 to inform their purchasing decision. In one example, the transparent and/or translucent nature of corner protectors 32 allows a consumer to fully visually inspect the corner construction of product 12. By allowing the consumer to tactilely and visually examine product 12, the consumer is more at ease with the shopping process leading to consumer happiness that, in turn, promotes a good reputation for the manufacturer and/or retailer driving initial and repeat sales of items being offered for sale by the manufacturer and/or retailer. As a result, the retail product assembly 10, as described herein, provides a protective package 14 for product 12 that does not substantially restrict consumer observance of product 12.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A product package comprising a backer formed as a single piece, the backer including:

a back panel having an edge, one or more fold lines extending along the edge of the back panel, a slot positioned near the one or more fold lines, and a flange extending from the one or more fold lines away from the back panel, the flange being folded about the one or more fold lines to extend over the back panel; and a corner protector formed as a single piece separate from the backer, the corner protector including:

a front section extending substantially parallel to and spaced from the back panel of the backer, a side section extending from the front section to the backer, and a rear section extending from the side section opposite the front section, wherein the rear section of the corner protector extends through the slot of the backer and is maintained between the back panel and the flange.

2. The product package of claim 1, wherein:

the rear section of the corner protector is a first rear section of the corner protector, and the corner protector further includes a second rear section folded around the flange and extending along a surface of the flange opposite the rear section of the corner protector.

3. The product package of claim 2, wherein:

the flange includes an interior coupling aperture, the first rear section includes an interior tab, and the interior tab extends from the second rear section through the interior coupling aperture of the flange.

4. The product package of claim 1, wherein:

the slot is a first slot, the corner protector is a first corner protector positioned on a first corner of the back panel, the product package further comprises:

a second slot positioned near the one or more fold lines spaced from the first slot, and a second corner protector formed as a single piece separate from the backer and the first corner protector, and the second corner protector is coupled to the backer at least partially via the second slot, is partially maintained between the back panel and the flange, and is positioned on a second corner of the back panel.

5. The product package of claim 1, wherein:

the one or more fold lines is a pair of two fold lines extending substantially parallel to one another, and the slot is defined substantially entirely between the pair of two fold lines.

6. The product package of claim 1, wherein:

the side section of the corner protector is a first side section of the corner protector, the corner protector further comprises:

a flap folding about a fold line positioned between the flap and the first side section to extend substantially perpendicular to the first side section, and a second side section extending from the front section to the backer and over the flap, the second side section having a substantially perpendicular orientation relative to each of the first side section and the front section.

7. The product package of claim 6, wherein:

the backer defines a side slot adjacent the back panel, the corner protector defines a tab extending from an edge of the second side section opposite the front section, and the tab is inserted into the side slot to further secure the corner protector to the backer.

8. The product package of claim 7, wherein:

the flange is a first flange of the backer, the edge of the back panel is a first edge of the back panel, the back panel defines a second edge, a fold line pair is defined along the second edge of the back panel, the backer further comprises a second flange extending from the fold line pair away from the back panel and being folded over the back panel to be positioned to extend away from the first flange, and the side slot is defined between two fold lines of the fold line pair.

9. The product package of claim 8, wherein the first flange and the second flange are coplanarly positioned relative to one another over the backer.

10. The product package of claim 1, further comprising a hanger coupled to the back panel of the backer to facilitate hanging the product package from a support structure.

11. The product package of claim 1, wherein:

the edge is a first edge of the back panel, the back panel includes a second edge opposite the first edge, the one or more fold lines is a first set of one or more fold lines, the slot is a first slot, the flange is a first flange, and the backer further comprises:

a second set of one or more fold lines extending along the second edge of the back panel, a second slot positioned near the second set of one or more fold lines, and a second flange extending from the second set of one or more fold lines away from the back panel, the second flange being folded about the second set of one or more fold lines to extend over the back panel.

12. The product package of claim 11, wherein:

the corner protector is a first corner protector, and the product package further comprises a second corner protector formed as a single piece separate from the backer and the first corner protector, the second corner protector is coupled to the backer at least partially via the second slot and is partially maintained between the back panel and the second flange.

13. The product package of claim 1, wherein:

the back panel is formed of a cardboard material, and the corner protector is formed of a plastic material.

14. The product package of claim 13, wherein the plastic material is folded to form the corner protector and is one of translucent and transparent.

15. The product package of claim 1, in combination with a product, wherein at least a portion of a corner of the product is maintained between and adjacent to each of the front section of the corner protector and the flange of the backer.

16. A package for maintaining a retail product, the package comprising:

means for substantially entirely covering a rear surface of the retail product;

means for partially covering an interior surface of the means for substantially entirely covering along an outer perimeter edge of the means for substantially entirely covering such that the means for partially covering is configured to extend between the rear surface of the retail product and the means for substantially entirely covering, wherein the means for partially covering is formed as a single piece with the means for substantially entirely covering;

a slot extending between the means for substantially entirely covering and the means for partially covering; and means for defining a chamber partially over a side of the means for partially covering opposite the means for substantially entirely covering, wherein the means for defining the chamber is configured to receive a corner of the retail product, the means for defining the chamber extends through the slot and is at least partially maintained between the means for substantially entirely covering and the means for partially covering.

17. The package of claim 16, further comprising:

the retail product positioned in the chamber snugly between the means for partially covering and the means for defining the chamber such that the means for substantially entirely covering substantially entirely covers the rear surface of the retail product.

18. A method of assembling a product package, the method comprising:

inserting a corner protector partially through a slot in a backer, wherein the slot is defined between a back panel of the backer and a flange of the backer, and the flange initially extends away from the back panel;

folding the flange of the backer over an adjacent edge of the back panel of the backer such that the corner protector is partially maintained between the flange and the back panel;

folding the corner protector to define a first side section forwardly extending from the backer;

folding the corner protector to define a front section adjacent the first side section and spaced from and extending substantially parallel to the back panel; and folding the corner protector to define a second side section extending from the front section of the corner protector to a different edge of the back panel.

19. The method of claim 18, further comprising:

securing a tab of the corner protector that extends from the second side section through a second slot defined by the backer to secure the corner protector in place relative to the backer.

20. The method of claim 19, further comprising:

folding a second flange of the backer over the different edge of the back panel such that the second slot is defined between the back panel and the second flange.

21. The method of claim 18, further comprising:

wrapping a rear section of the corner protector around an edge of the flange opposite the slot in the backer and over a surface of the flange opposite the back panel; and securing an internal tab in the rear section of the corner protector through an internal aperture defined by the flange.

* * * * *